United States Patent [19]

Bugamelli

[11] 4,193,947

[45] Mar. 18, 1980

[54] CARBURETING DISCHARGE MEANS

[75] Inventor: Ralph Bugamelli, Sterling Heights, Mich.

[73] Assignee: Colt Industries Operating Corp., New York, N.Y.

[21] Appl. No.: 888,504

[22] Filed: Mar. 20, 1978

[51] Int. Cl.[2] ..... F02M 3/08

[52] U.S. Cl. ..... 261/41 D; 261/78 R; 261/DIG. 39

[58] Field of Search ..... 261/41 D, DIG. 39, 44 E, 261/62, 78 R

[56] References Cited

U.S. PATENT DOCUMENTS

| | | | |
|---|---|---|---|
| 1,301,623 | 4/1919 | Upton | 261/62 |
| 1,601,198 | 9/1926 | Chappel | 261/41 D |
| 1,607,052 | 11/1926 | Brinkman | 261/53 |
| 2,297,109 | 9/1942 | Moseley | 261/41 D |
| 2,807,449 | 9/1957 | Manning, Jr. | 261/41 D |
| 3,326,539 | 6/1967 | Phipps | 261/78 R |
| 3,347,536 | 10/1967 | Sutton | 261/DIG. 39 |
| 3,575,390 | 4/1971 | Bickhaus | 261/62 |
| 3,664,648 | 5/1972 | Seeley, Jr. | 261/DIG. 39 |
| 3,746,320 | 7/1973 | Van Camp et al. | 261/DIG. 68 |
| 3,796,415 | 3/1974 | Dreher | 261/41 D |
| 4,000,224 | 12/1976 | Phelps | 261/41 D |
| 4,020,805 | 5/1977 | Konomi et al. | 123/141 |

FOREIGN PATENT DOCUMENTS

| | | | |
|---|---|---|---|
| 754599 | 7/1949 | Fed. Rep. of Germany | 261/41 D |
| 834486 | 11/1938 | France | 261/41 D |
| 246489 | 1/1927 | United Kingdom | 261/DIG. 39 |
| 1207963 | 7/1970 | United Kingdom | 261/DIG. 39 |
| 1278292 | 6/1972 | United Kingdom | 261/44 E |

*Primary Examiner*—Tim R. Miles

*Attorney, Agent, or Firm*—Walter Potoroka, Sr.

[57] ABSTRACT

A carburetor having an induction passage with a throttle valve therein has a fuel discharge port arrangement opening into the induction passage generally in the vicinity of an edge of the throttle valve so that as the throttle valve is more nearly opened the edge of the throttle valve, generally, traverses the discharge port arrangement as to effectively increase the functional flow of the discharge port arrangement and thereby effectively increase the rate of flow through the discharge port arrangement; a ledge-like surface situated generally in the induction passage and generally upstream of the discharge port arrangement results in an increase in turbulence of the medium flowing through the induction passage and a better atomization of the fluid flowing from the discharge port arrangement.

1 Claim, 8 Drawing Figures

CARBURETING DISCHARGE MEANS

BACKGROUND OF THE INVENTION

As is well-known in the art, carburetors employ, among other systems, an idle fuel system and a main fuel system. The main fuel system usually comprises a main fuel discharge nozzle (cooperating with related metering restriction means) situated generally within the throat of a venturi section of the induction passage and is therefore responsive to and effective for discharging fuel in accordance with the venturi vacuum generated by the flow of air therethrough. However, generally, at low engine speeds, including idle engine operation, the velocity of air flow through the venturi is insufficient to create a suitable metering vacuum.

Therefore, the idle fuel delivery system, which comprises an idle fuel discharge port communicating with the induction passage, downstream of the throttle valve when in its idle position, is employed to provide the required fuel during the lower range of engine operation. The idle fuel system, by virtue of the location of the idle fuel discharge port, is exposed and responsive to the value or magnitude of the engine intake manifold vacuum generated downstream of the throttle. It should be pointed out that, with certain possible exceptions, the value or magnitude of the manifold vacuum will be the greatest at idle and will diminish as the throttle is progressively moved in an opening direction. Therefore, with merely a fixed idle fuel discharge port, the fuel-air mixture would become leaner in fuel as the throttle were moved in the opening direction because of the fixed discharge area of the idle fuel discharge port and the reduction in the magnitude of the manifold vacuum which reduction accompanies increased throttle valve opening.

Consequently, in order to provide a smooth transition from the idle fuel system (responsive to engine vacuum) to the main fuel system (responsive to venturi vacuum created generally after air flow therethrough has attained a predetermined volocity) the prior art has provided fuel transfer port or slot means communicating with the induction passage and supplied with fuel generally from the idle fuel system. Although the exact location of the lower or terminal portion of such transfer port means is often dependent on the particular characteristics of the engine which is to employ the carburetor, generally, the transfer port means is so located within the induction passage as to be traversed by an edge of the throttle valve as the throttle valve is being moved toward a more fully opened position. In so traversing the transfer port means, the manifold vacuum existing immediately below (downstream of) the throttle valve is permitted to act on the progressively increasing exposed area of the transfer port means thereby increasing fuel flow therethrough and into the induction passage.

Although in years past such transfer port or slot means of the prior art have been generally accepted as being satisfactory, such prior art transfer means or arrangements have now been discovered as being less than satisfactory.

More specifically, the automotive industry has over the years, if for no other reason than seeking competitive advantages, continually exerted substantial efforts to increase the fuel economy of automotive engines. However, the gains continually realized thereby are also continuously being deemed by various governmental bodies as being insufficient with attendant ever-increasing requirements and standards being established regarding both engine fuel economy and engine exhaust emissions. The prior art, in attempting to meet such requirements and standards, has suggested certain improvements to the main fuel metering system of carburetors and to the idle fuel system, more particularly to the idle fuel discharge port and the needle valves employed for determining the effective flow area of such idle fuel discharge port. It has apparently been delivered that such idle fuel discharge ports and main fuel metering systems provided the only areas for improving the fuel economy of a related engine as well as degree of exhaust emissions produced by such associated engine.

It has now been discovered that further significant improvements in both engine fuel economy and levels of engine exhaust emissions are realized by employing a transfer fuel system or arrangement according to the present invention.

SUMMARY OF THE INVENTION

According to the invention, a carbureting apparatus for metering a liquid into a flowing stream of fluid comprises an induction passage through which said stream of fluid flows, a throttle valve for variably controlling the rate of flow of said fluid through the induction passage, said throttle valve having a movable edge which moves during such times as when the throttle valve is being more nearly opened or more nearly closed, liquid discharge port means formed generally in a wall of the induction passage as to be in communication therewith and located as to be generally traversed by said edge of said throttle valve as said throttle valve is being moved toward a more fully opened position, and ledge means carried generally in said induction passage means upstream of said port means, said ledge being effective to cause turbulence in the proximate vicinity of said port means of said fluid flowing through said induction passage and thereby effect greater atomization of said liquid flowing from said port means.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
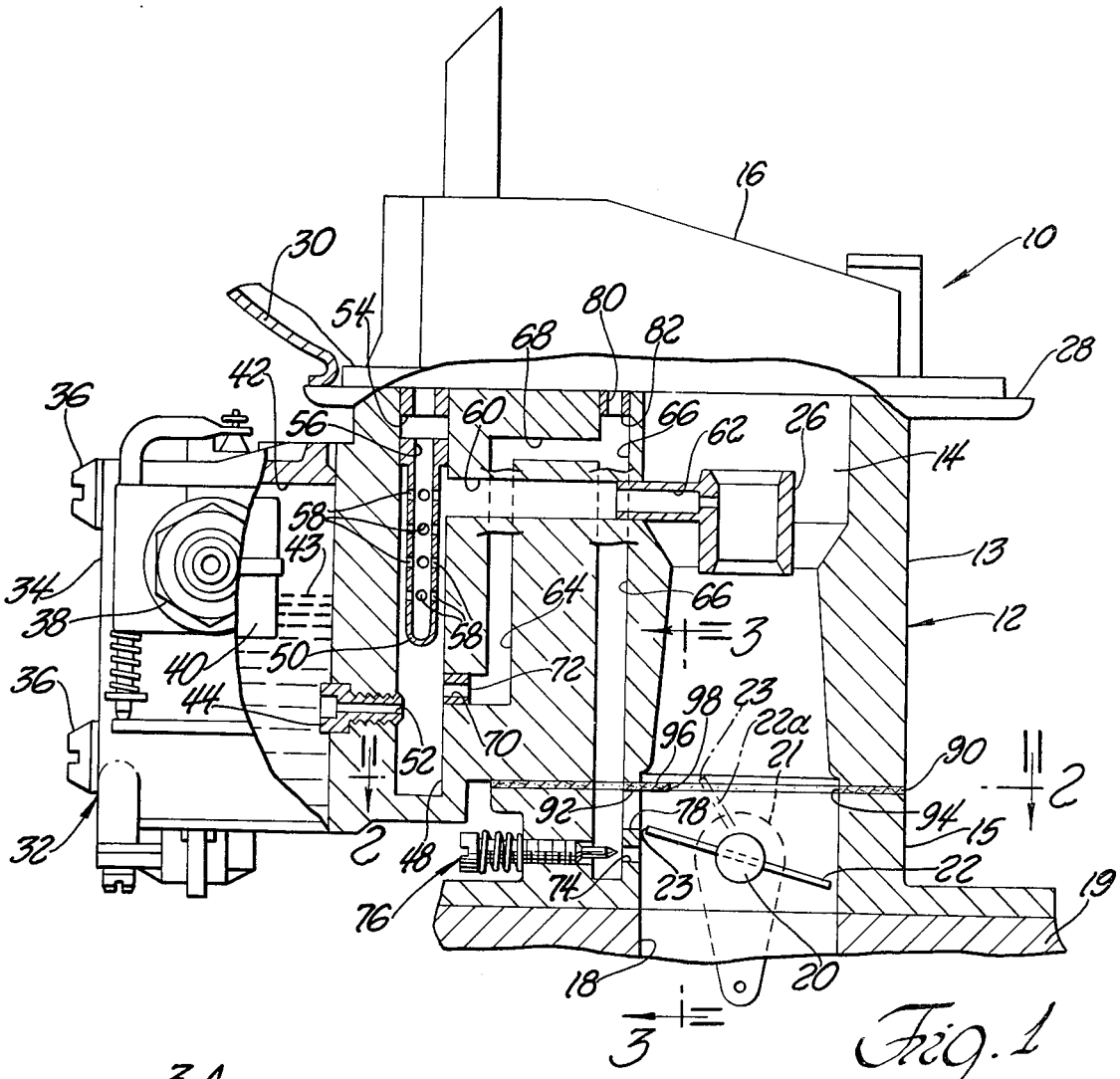
FIG. 1 is an elevational cross-sectional view of a carburetor, employing teachings of the invention, with certain of the elements being illustrated in somewhat simplified form for purposes of clarity.

Referring now in greater detail to the drawings, FIG. 1 illustrates a carburetor 10 having body means 12, which may be comprised of a main body section 13 and a throttle body section 15 suitably secured to each other, with an induction passage 14 formed therethrough communicating at its upper end with and air inlet section 16 (in which a choke valve, not shown but well-known in the art, may be situated) and adapted for communication at its lower end with the interior 18 of an intake manifold 19 of an associated combustion engine. A generally transversely extending throttle shaft 20, journalled for rotation as in the carburetor body section 15, has a throttle valve 22 secured thereto for pivotal rotation therewith. Suitable control linkage means, depicted as at 21, may be connected to throttle shaft 20 to effect rotation thereof as in accordance with engine operator demands.

The induction passage 14 may be provided with a venturi section 24 within the throat of which a main fuel discharge nozzle 26 is situated so as to at times discharge main metered fuel in accordance with the volume rate of air flow through the venturi throat.

The upper portion of the carburetor body means 12 and body section 13 may have a flange 28 formed thereabout so as to receive thereon and carry a suitable air cleaner assembly 30.

A fuel bowl assembly 32, including a housing 34 secured as to body section 13 as by elongated screws 36, comprising a fuel inlet valve assembly 38 controlled by a float 40 within the fuel bowl chamber 42, serves to supply liquid fuel 43 to the fuel metering restriction or calibration means 44.

A main fuel well 48 may contain a main well tube 50 and communicate generally at its lower end with the fuel 43 within the fuel bowl chamber 42 as through the calibrated passage 52 of restriction means 44. The upper end of main well 48 is placed in communication with a source of atmosphere as by a calibrated main air bleed or restriction 54 which may be vented to the interior of the air inlet section 16. As is generally well-known in the art, the function of the main well tube, which has an axial passageway 56 and a plurality of radial apertures or passages 58 communicating between the inner passageway 56 and the interior of main well 48, is to provide a controlled rate of bleed air to be mixed with the fuel flowing upwardly through the main well and out through conduit portions 60 and 62 thereby reducing the effective weight of the fuel in order to make it more responsive to the variations of venturi vacuum developed at the throat of venturi section or portion 24. Further, as is also generally well-known in the art, the main nozzle 26 does not supply a metered rate of fuel flow to the induction passage 14 until the engine speed and load are sufficiently great to cause a velocity rate of air flow through the venturi portion 24 equal to or in excess of a predetermined minimum velocity rate of such air flow.

Accordingly, for engine operating conditions wherein the actual velocity rate of air flow through the venturi section 24 is below such a predetermined minimum velocity rate, an idle fuel system is provided in order to supply a metered rate of idle fuel flow to the induction passage 14. As is well-understood by those skilled in the art, the idle fuel system functions to meter idle fuel flow to the induction passage in accordance with the magnitude of the manifold vacuum developed by the engine within the intake manifold 19.

As generally depicted in FIG. 1, the idle fuel system may be comprised of an idle well 64 having its upper end in communication with a generally vertically disposed conduit 66 as by means of a horizontal conduit portion 68. The lower end of idle well 64 communicates with the main well 48 as through calibrated passage means 70 formed as in idle fuel metering restriction means 72. The lower end of conduit 66 communicates with the induction passage 14 as by an idle fuel discharge port 74 the effective area of which can be adjustably determined as by a threadably adjustable idle fuel needle valve assembly 76. As indicated, the port 74 is intended to discharge metered idle fuel into the induction passage 14 at a point generally downstream of the throttle valve 22 when the throttle valve is in its nominally closed or curb-idle position.

The lower end of conduit 66 is also in communication with second discharge port means 78 which, in the embodiment shown in FIG. 1, comprises a generally vertically elongated slot. The discharge or transfer port means 78 is located as to be somewhat above idle discharge port 74. Further, preferably, as generally depicted, when the throttle valve 21 is in its closed position as shown in FIG. 1, the edge of throttle valve 22 closest to the transfer discharge port is so positioned relative thereto as to effectively preclude the communication of manifold or engine vacuum thereto. The purpose of transfer discharge port means 78 is to provide a fuel flow therethrough whenever the throttle valve 22 has been sufficiently rotated in the throttle-opening direction as to expose the port means 78 to the manifold vacuum generally below the throttle valve 22. The intention in providing such a transfer discharge port 78 is to enable a smooth transition from the idle fuel system to the main fuel system. Further, as shown, the upper end of conduit 66 is placed in controlled communication with the atmosphere as by the calibrated passage 80 of an air bleed restriction 82 which performs a function similar to main air bleed restriction 54 in that it serves to supply a controlled rate of air flow into the conduit 66 or 68 as to have such air mix with the idle fuel being supplied by the idle well 64 in order to make such mixture lighter and more responsive to sensed variations in the magnitude of the intake manifold vacuum. Air bleed restriction 82 may, of course, be vented to the interior of the air intake section 16.

Figure 2:
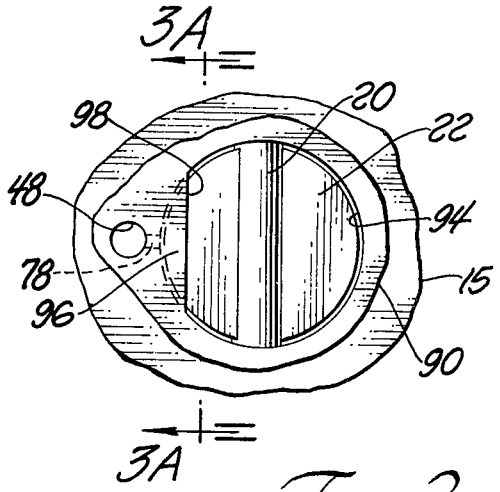
FIG. 2 is a fragmentary cross-sectional view taken generally on the plane of line 2—2 of FIG. 1 and looking in the direction of the arrows.
Figure 3:
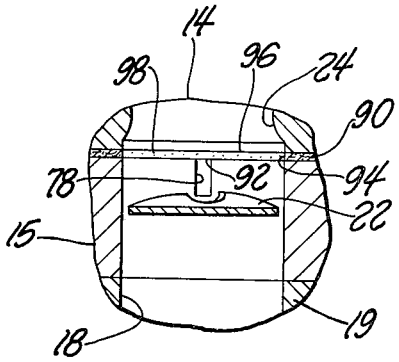
FIG. 3 is a fragmentary cross-sectional view taken generally on the plane of either line 3—3 of FIG. 1 or line 3A—3A of FIG. 2 and looking in the direction of the arrows.

In the embodiment of FIG. 1, the transfer discharge port 78 is shown as being formed in the carburetor body section 15 and such body section or throttle body 15 is, in turn, shown operatively connected to the carburetor body section 13 with a gasket member 90 situated generally therebetween. The gasket member 90 may be of a composite structure or any other form many of which are well-known in the art. In any event, in the embodiment shown, the lower surface portion, as at 92, of gasket member 90 defines the upper surface limit of transfer fuel port means 78. Further, gasket member 90 has an aperture 94 formed therein which generally conforms to the contour of the induction passage at that location except that the gasket 90 provides a portion 96 which generally projects into induction passage 14 a distance which will not interfere with the rotation of the throttle valve 22 toward a more fully opened position (one of which is depicted at 22*a*). As illustrated in FIG. 1, sufficient clearance is provided as between edge 98 of portion 96 and edge 23 of throttle valve 22 thereby permitting such throttle valve rotation. In the embodiment of FIGS. 1, 2 and 3, the edge 98 of projecting portion 96 (as possibly best seen in FIG. 2) is basically straight and thereby defines a chord-like configuration with respect to the circular configuration of the remaining portion of aperture 94 or the induction passage 14 at that location. FIG. 3 better illustrates the general configuration of the transfer fuel discharge port means 78 and, in order to more clearly illustrate such, a portion of the sectioned throttle valve 22, in the vicinity of port means 78 has been broken away.

OPERATION OF INVENTION

With the associated combustion engine operating, as the throttle valve 22 is being moved from, for example, the solid line position thereof in FIG. 1 to, for example, the position depicted at 22*a*, the edge 23 thereof starts to generally traverse discharge port means 78 and, as previously described and explained, exposes an ever-increasing area of the discharge port means 78 to the engine or manifold vacuum existing downstream or posterior to the throttle valve 22. This, of course, results in an increasing rate of fuel flow through discharge port means 78 and into induction passage 14. With the invention, that is, the provision of turbulence creating ledge means, as portion 96, the air flowing downwardly (in FIG. 1) through the induction passage 14 undergoes turbulence in the vicinity of the ledge means 96 and as such enhances the mixing effect of the fuel (liquid) being discharged from the port means 78 with the air (fluid) flowing through the induction passage 14. Further, such turbulence has a secondary effect in that the turbulence per se causes a further breakdown in the physical size of the fuel droplets being discharged from port means 78 and consequently results in a better atomization of such fuel and a more uniform dispersion thereof within the air flowing into the engine. In this connection it has also been noted that because of the ledge portion 96, apparently there is created a relatively lower pressure immediately beneath (downstream side of) the ledge 96 across its entire effective downstream surface. Consequently, when fuel is discharged from port means 78 it does not merely immediately flow downwardly in a relatively narrow stream; instead, such discharged fuel tends to first spread-out or disperse laterally under the entire effective downstream surface of ledge 96 and then flow downwardly. This spreading-out of the fuel further enhances its mixing with the air flowing through the induction passage and into the associated engine.

Figure 4:
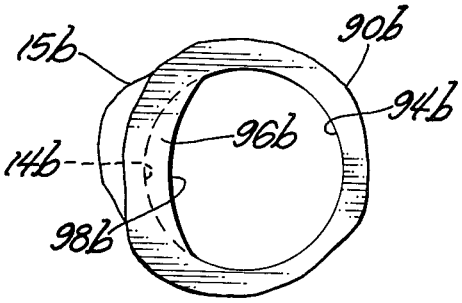
FIGS. 4 and 5 are each views similar to FIG. 2 but respectively illustrating further modifications of the invention.

FIG. 4 is a view somewhat similar to FIG. 2, but further simplified, illustrating a modification of the invention. The elements in FIG. 4 which are like or similar to those of FIG. 2 are identified with like reference numbers provided with a suffix "b". In comparing the embodiments of FIGS. 2 and 4, it can be seen that the main difference is that in the embodiment of FIG. 4 the edge 98*b* is curvilinear instead of straight as at 98 of FIG. 2. With the embodiment of FIG. 4, it becomes possible to obtain an even further lateral spreading of the fuel as it first exits the discharge port means 78.

Figure 5:
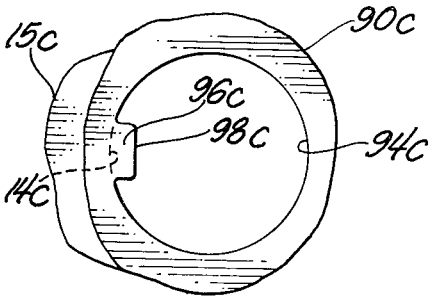

FIG. 5 is a view similar to FIGS. 2 and 4 but illustrating a further modification of the invention. The elements in FIG. 5 which are like or similar to those of FIG. 2 or 4 are identified with like reference numbers provided with a suffix "c". In comparing the embodiment of FIG. 5 to either of the embodiments of FIG. 2 or 4, it can be seen that the main difference is that in FIG. 5 the projecting portion 96*c* is laterally narrower and has a tab-like or tongue-like configuration with the projecting edge 98*c* being relatively short compared to edges 98 and 98*b*.

Figure 6:
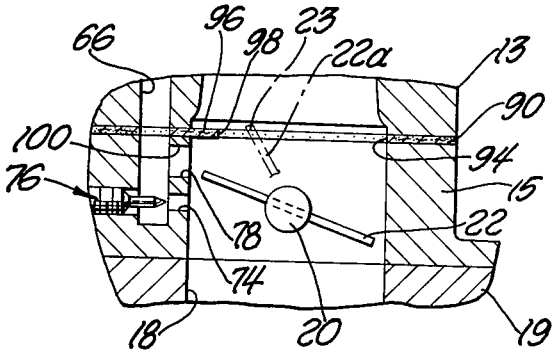
FIGS. 6 and 7 are each views similar to a fragmentary portion of FIG. 1 with each showing a further modification thereof.

FIG. 6 is a view similar to a fragmentary portion of the structure of FIG. 1. All elements in FIG. 6 which are like or similar to those of FIG. 1 are identified with like reference numbers. In comparing the structures of FIGS. 1 and 6, it can be seen that the main difference in FIG. 6 is that the slot-like discharge port means 78 terminates at its upper end in an end surface 100 formed in carburetor body means 15 instead of being defined by the portion 92 of the undersurface of gasket member 90 as depicted in FIG. 1.

Figure 7:
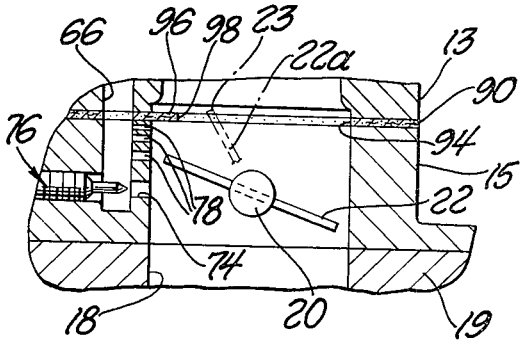

FIG. 7 is a view similar to a fragmentary portion of the structure of FIG. 1. All elements in FIG. 6 which are like or similar to those of FIG. 1 are identified with like reference numbers. In comparing the structures of FIGS. 1 and 7, it can be seen that the main difference in FIG. 7 is that the discharge port means 78, instead of being an elongated slot as shown in FIGS. 1, 3 and 6, is instead comprised of a plurality of apertures or passages preferably aligned as to have their respective axes generally in a vertically extending plane.

Figure 8:
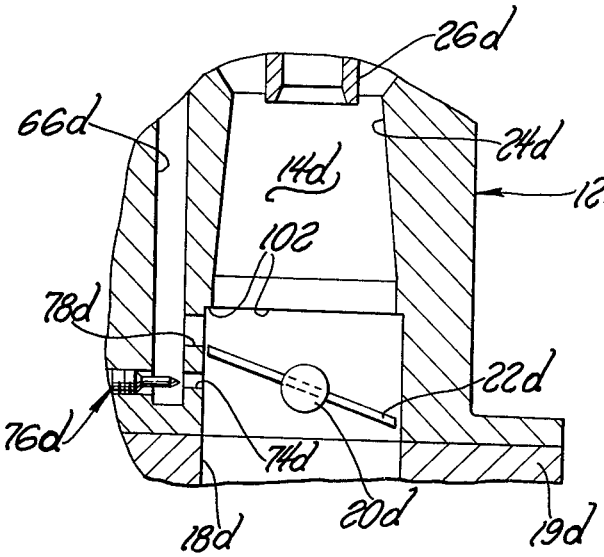
FIG. 8 is a view similar to a fragmentary portion of FIG. 1 illustrating yet another modification of the invention.

FIG. 8 is a view similar to a fragmentary portion of the structure shown in FIG. 1 but illustrating a further embodiment of the invention. All elements in FIG. 8 which are like or similar to those of FIG. 1 are identified with like reference numbers provided with a suffix "d". Only so much of the overall structure is shown as is considered necessary or desirable in order to fully understand the said further embodiment. In the embodiment of FIG. 8 the turbulence creating ledge means is created as by preferably forming a step or shoulder 102 within induction passage 14*d* as to be upstream of discharge port means 78*d* and preferably circumferentially about the induction passage. As in the previous embodiments, the turbulence producing means 102 causes a lesser pressure to exist in the area downstream of and adjacent to the means 102 thereby causing at least a portion of the fuel being discharged from the port means 78*d* to travel generally laterally therefrom before flowing downwardly, with the passing air stream, into the associated engine. Under certain circumstances, a portion of such laterally traveling fuel will actually travel completely about and under the means 102 thereby resulting in an extremely well-mixed fuel-air mixture flowing downstream thereof.

It has been observed that engines employing carbureting structures which, in turn, employ teachings of the invention have shown a marked increase in fuel economy (and by deduction reduced levels of engine emissions). It is believed that such occurs because of the greater atomization effect on the particles of fuel being discharged into the air stream as well as the greater mixing of fuel particles and air.

Although only a preferred embodiment and selected modifications of the invention have been disclosed and described, it is apparent that other embodiments and modifications of the invention are possible within the scope of the appended claims.

What is claimed is:

1. A carburetor, comprising body means, said body means comprising a main body section and a throttle body section operatively connected to each other, a generally cylindrical air induction passage means formed through said main body section and said throttle body section, an annular venturi restriction in that portion of said passage means, formed in said main body section, a main fuel nozzle for discharging main fuel into said passage at said venturi, an idle fuel discharge port in said throttle body section as to communicate with said passage means downstream from said nozzle for discharging idle fuel into said passage means, a butterfly throttle valve pivotally mounted in said passage means as to be carried by said throttle body section and situated between said venturi and said discharge port, a transfer fuel port formed in and carried by said throttle body section at one side of said passage means for discharging transfer fuel into said passage, said transfer port being disposed downstream of said venturi and adjacent said throttle valve so as to be traversed by an edge of said throttle valve upon opening movement thereof, gasket means having upper and lower planar surfaces situated and retained between said main body section and said throttle body section as to have said upper planar surface juxtaposed to said main body section and said lower planar surface juxtaposed to said throttle body section, said gasket means having an aperture formed therethrough as to have the periphery of said aperture for the major portion thereof closely conform to the axially transverse cross-sectional configuration of said passage means immediately upstream and downstream of said gasket means, said gasket means further comprising an air turbulence generating planar portion projecting radially inwardly of said passage means and terminating in a projecting edge which edge extends to and from said periphery of said aperture, said upper planar surface extending to and terminating in said projecting edge, said lower planar surface extending to and terminating in said projecting edge, said turbulence generating planar portion being situated immediately upstream of said transfer port as to thereby result in having the air flowing in said passage means immediately upstream of said turbulence generating portion impinge upon said extending upper planar surface thereof and by resulting turbulence be deflected generally radially inwardly of said passage means as to continue its flow through said passage means only after passing around said projecting edge.

* * * * *